US010677141B2

(12) United States Patent
Michikawauchi

(10) Patent No.: US 10,677,141 B2
(45) Date of Patent: Jun. 9, 2020

(54) COOLING SYSTEM FOR INTERNAL COMBUSTION ENGINE

(71) Applicant: TOYOTA JIDOSHA KABUSHIKI KAISHA, Toyota-shi, Aichi-ken (JP)

(72) Inventor: Ryo Michikawauchi, Numazu (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/531,127

(22) PCT Filed: Nov. 27, 2015

(86) PCT No.: PCT/JP2015/005912
§ 371 (c)(1),
(2) Date: May 26, 2017

(87) PCT Pub. No.: WO2016/084386
PCT Pub. Date: Jun. 2, 2016

(65) Prior Publication Data

US 2017/0321597 A1 Nov. 9, 2017

(30) Foreign Application Priority Data

Nov. 28, 2014 (JP) ..... 2014-241483

(51) Int. Cl.
*F01P 7/16* (2006.01)
*F01P 11/00* (2006.01)
(Continued)

(52) U.S. Cl.
CPC ..... *F01P 7/165* (2013.01); *F01P 3/18* (2013.01); *F01P 3/20* (2013.01); *F01P 7/10* (2013.01);
(Continued)

(58) Field of Classification Search
CPC ..... B60K 11/085; B60K 11/04; B60K 11/02; F01P 7/12; F01P 3/20; F01P 11/16; F01P 7/02
See application file for complete search history.

(56) References Cited

U.S. PATENT DOCUMENTS 4,475,485 A * 10/1984 Sakakibara ..... F01P 7/026 123/41.05
4,771,739 A * 9/1988 Hapka ..... F01P 7/167 123/41.09
(Continued)

FOREIGN PATENT DOCUMENTS

EP 1431698 A2 6/2004
JP S58-124017 A 7/1983
(Continued)

*Primary Examiner* — Long T Tran
(74) *Attorney, Agent, or Firm* — Hunton Andrews Kurth LLP

(57) ABSTRACT

A heat radiation amount from the cooling water in the radiator is adjusted so that the temperature of the cooling water is less than a prescribed temperature that is a temperature higher than the threshold value if a load exerted on the internal combustion engine is not less than a predetermined load, while the heat radiation amount from the cooling water in the radiator is adjusted so that the heat radiation amount from the cooling water in the radiator is increased if the load exerted on the internal combustion engine is less than the predetermined load as compared with if the load exerted on the internal combustion engine is not less than the predetermined load.

5 Claims, 4 Drawing Sheets

(51) Int. Cl.
*F01P 3/20* (2006.01)
*F01P 7/10* (2006.01)
*F01P 3/18* (2006.01)

(52) U.S. Cl.
CPC ..... *F01P 7/16* (2013.01); *F01P 11/00* (2013.01); *F01P 2003/187* (2013.01); *F01P 2007/168* (2013.01); *F01P 2025/32* (2013.01); *F01P 2025/62* (2013.01); *F01P 2025/64* (2013.01)

(56) References Cited

U.S. PATENT DOCUMENTS 5,353,757 A 10/1994 Susa et al.
5,609,125 A * 3/1997 Ninomiya ..... F01P 7/08 123/41.12
6,591,174 B2 * 7/2003 Chung ..... F01P 7/048 123/41.12
8,645,028 B2 * 2/2014 Mochizuki ..... B60K 11/085 123/41.05
8,731,783 B2 * 5/2014 Hayakawa ..... B60K 11/085 701/49
9,103,265 B2 * 8/2015 Okamoto ..... F01P 7/026
2008/0283215 A1 * 11/2008 Saida ..... B60H 1/00828 165/43
2011/0137530 A1 6/2011 Kerns
2011/0246023 A1 * 10/2011 Lockwood ..... F01P 7/10 701/36
2011/0288717 A1 * 11/2011 Yu ..... B60K 11/085 701/31.4
2012/0106590 A1 * 5/2012 Suzuki ..... F01P 11/16 374/1
2013/0092462 A1 * 4/2013 Chinta ..... B60K 11/085 180/68.1
2013/0255605 A1 * 10/2013 Jentz ..... F01P 11/16 123/41.15
2013/0264133 A1 * 10/2013 Remy ..... B60K 11/085 180/68.1
2014/0039765 A1 * 2/2014 Charnesky ..... F01P 7/10 701/49
2014/0117104 A1 * 5/2014 Inaba ..... B60H 1/00899 237/28
2014/0142819 A1 * 5/2014 Pursifull ..... F01P 11/16 701/51
2014/0230760 A1 * 8/2014 Okamoto ..... F01P 7/026 123/41.05
2014/0290599 A1 * 10/2014 Numata ..... F01P 7/10 123/41.05
2015/0088364 A1 * 3/2015 Sakayori ..... F01P 11/16 701/29.7

FOREIGN PATENT DOCUMENTS

JP S59-34023 U 3/1984
JP H03-41122 U 4/1991
JP H08-197965 A 8/1996
JP 2002-038949 A 2/2002
JP 2008-006855 A 1/2008
JP 2010-149691 A 7/2010

* cited by examiner

COOLING SYSTEM FOR INTERNAL COMBUSTION ENGINE

CROSS REFERENCE TO RELATED APPLICATIONS

This application is a National Stage of International Application No. PCT/JP2015/005912, filed on Nov. 27, 2015, claiming priority based on Japanese Patent Application No. 2014-241483 filed on Nov. 28, 2014, the contents of all of which are incorporated herein by reference in their entirety.

TECHNICAL FIELD

The present disclosure relates to a cooling system for an internal combustion engine.

BACKGROUND ART

A system is known, which comprises a radiator for releasing or radiating the heat from the cooling water for an internal combustion engine and a grill shutter for shutting off the flow of the air directed to the radiator, wherein the air is allowed to flow to the radiator by opening the grill shutter when the temperature of the cooling water exceeds a preset temperature (see, for example, Patent Literature 1).

CITATION LIST

Patent Literature

[PTL 1] Japanese Patent Application Laid-Open No. 2008-006855

[PTL 2] Japanese Patent Application Laid-Open No. 2002-038949

[PTL 3] Japanese Patent Application Laid-Open No. 08-197965

[PTL 4] Japanese Patent Application Laid-Open No. 2010-149691

SUMMARY OF INVENTION

Technical Problem

In this context, the temperature of a combustion chamber is raised during the high load operation of the internal combustion engine, and hence the knocking easily occurs. In order to suppress the occurrence of the knocking, it is effective to increase the flow rate of the cooling water which cools the combustion chamber. However, if the control is performed such that the temperature of the cooling water is lowered during the high load operation of the internal combustion engine by using, for example, the grill shutter, a thermostat is closed. In relation thereto, when the thermostat is open, the cooling water flows through the radiator and a passage which bypasses the radiator. When the thermostat is closed, the cooling water flows through only the bypass passage. Therefore, when the thermostat is closed, it is impossible for the cooling water to flow through the radiator. Therefore, the pressure loss is increased corresponding thereto, and the amount of the cooling water circulating through the internal combustion engine is consequently decreased. In relation thereto, if the flow rate of the cooling water is large, it is possible to deprive a larger amount of heat from the combustion chamber. Therefore, if the flow rate of the cooling water is decreased on account of the closure of the thermostat, the effect of the temperature decrease of the combustion chamber is decreased. On the other hand, the temperature of the combustion chamber is low during the low load operation of the internal combustion engine, and hence the knocking hardly occurs. Therefore, it is unnecessary to increase the flow rate of the cooling water during the low load operation of the internal combustion engine.

The present disclosure has been made taking the foregoing problem into consideration, an object of which is to realize a proper flow rate of cooling water for an internal combustion engine.

Solution to Problem

In order to achieve the object as described above, according to the present disclosure, there is provided a system comprising a radiator configured to radiate heat from cooling water for an internal combustion engine; a radiator side cooling water route configured to circulate the cooling water through the radiator and the internal combustion engine; a bypass side cooling water route configured to circulate the cooling water through the internal combustion engine while detouring the radiator; a changer configured to allow the cooling water to flow through the radiator side cooling water route and the bypass side cooling water route if a temperature of the cooling water for the internal combustion engine is not less than a threshold value and configured to allow the cooling water to flow through the bypass side cooling water route while not allowing the cooling water to flow through the radiator side cooling water route if the temperature of the cooling water for the internal combustion engine is less than the threshold value; a heat radiation amount varier configured to vary a heat radiation amount from the cooling water in the radiator; and a controller programmed to control the heat radiation amount varier such that the temperature of the cooling water is less than a prescribed temperature that is a temperature higher than the threshold value if a load exerted on the internal combustion engine is not less than a predetermined load and configured to control the heat radiation amount varier such that the heat radiation amount from the cooling water in the radiator is increased if the load exerted on the internal combustion engine is less than the predetermined load as compared with if the load exerted on the internal combustion engine is not less than the predetermined load.

When the temperature of the cooling water for the internal combustion engine is not less than the threshold value and the heat radiation amount from the cooling water in the radiator is large, if the cooling water is allowed to flow through the radiator side cooling water route, then it is possible to lower the temperature of the cooling water. On the other hand, when the temperature of the cooling water for the internal combustion engine is less than the threshold value, if the cooling water is not allowed to flow through the radiator side cooling water route, then it is possible to raise the temperature of the cooling water. Further, when the temperature of the cooling water for the internal combustion engine is not less than the threshold value and the heat radiation amount from the cooling water in the radiator is small, even if the cooling water is allowed to flow through the radiator side cooling water route, i.e., even if the cooling water is allowed to flow through the radiator, then the temperature of the cooling water is raised.

In this case, the flow rate of the cooling water in the internal combustion engine is rather increased when the cooling water is allowed to flow through both of the radiator side cooling water route and the bypass side cooling water route as compared with when the cooling water is allowed to flow through only the bypass side cooling water route. Then, it is possible to deprive a larger amount of heat from the internal combustion engine by increasing the flow rate of the cooling water. Therefore, it is possible to further lower the temperature of the internal combustion engine. However, when the cooling water flows through the radiator and the temperature of the cooling water is lowered, then the changer changes or switches the route so that the cooling water flows through only the bypass side cooling water route. Therefore, the flow rate of the cooling water is consequently decreased. In relation thereto, it is possible to suppress the decrease in the temperature of the cooling water by decreasing the heat radiation amount in the radiator by means of the heat radiation amount varier. Accordingly, the changer allows the cooling water to flow through both of the radiator side cooling water route and the bypass side cooling water route. Therefore, it is possible to further increase the flow rate of the cooling water in the internal combustion engine.

However, when the heat radiation amount in the radiator is decreased, then the temperature of the cooling water is excessively raised, and it is feared that the internal combustion engine may be overheated. In relation thereto, it is possible to suppress the excessive increase in the temperature of the cooling water by controlling the heat radiation amount varier so that the temperature of the cooling water is less than the prescribed temperature.

In this case, the threshold value is set so that the temperature of the cooling water is the required temperature when the load exerted on the internal combustion engine is less than the predetermined load (during the low load operation of the internal combustion engine). Further, the prescribed temperature may have a value larger than the threshold value, which can be a temperature of the cooling water at which it is feared that the internal combustion engine may be overheated or a temperature of the cooling water at which the internal combustion engine is overheated. It is possible to say that the heat radiation amount from the cooling water in the radiator, which is provided when the load exerted on the internal combustion engine is less than the predetermined load, is the heat radiation amount at which the temperature of the cooling water is less than the threshold value when the cooling water flows through the radiator.

When the load exerted on the internal combustion engine is less than the predetermined load, the occurrence of the knocking is suppressed even when the flow rate of the cooling water is not increased. On this account, it is unnecessary to increase the flow rate of the cooling water. Further, when the load exerted on the internal combustion engine is less than the predetermined load, the fuel efficiency (fuel consumption) can be rather improved by reducing the friction loss and/or the cooling loss by raising the temperature of the combustion chamber. That is, when the temperature of the combustion chamber is maintained to be high by lowering the flow rate of the cooling water during the low load operation as compared with during the high load operation, it is possible to improve the fuel efficiency. In this case, when the load exerted on the internal combustion engine is less than the predetermined load, the temperature of the cooling water for the internal combustion engine is less than the threshold value by increasing the heat radiation amount from the cooling water in the radiator. Accordingly, the cooling water does not flow through the radiator side cooling water route. Therefore, the temperature of the cooling water is raised to a temperature which is not less than the threshold value. If such a situation arises, the cooling water in turn flows through the radiator side cooling water route. Therefore, the temperature of the cooling water is lowered. When the process as described above is repeatedly performed, the temperature of the cooling water for the internal combustion engine is thereby maintained in the vicinity of the required temperature, if the load exerted on the internal combustion engine is less than the predetermined load.

Further, it is also appropriate that the heat radiation amount varier is a shutter which opens/closes on a flow passage for air when the air passes through the radiator.

According to this shutter, the larger the opening degree of the shutter is, the more increased the amount of the air passing through the radiator is. Therefore, it is possible to deprive a larger amount of heat from the cooling water. Therefore, it is possible to adjust the temperature of the cooling water by adjusting the opening degree of the shutter. Note that the shutter may be one which can be fully opened and fully closed and which maintains only any one of the states or the shutter may be one which can maintain an arbitrary opening degree.

Further, it is also appropriate that the changer is a thermostat configured to allow the cooling water to flow through the radiator side cooling water route and the bypass side cooling water route if the temperature of the cooling water for the internal combustion engine is not less than the threshold value and configured to allow the cooling water to flow through the bypass side cooling water route while not allowing the cooling water to flow through the radiator side cooling water route if the temperature of the cooling water for the internal combustion engine is less than the threshold value.

The thermostat automatically opens/closes in accordance with the temperature in the radiator side cooling water route. When the thermostat as described above is provided, if the temperature of the cooling water is less than the threshold value, then the cooling water does not flow through the radiator automatically, and hence the flow rate of the cooling water is consequently decreased. In relation thereto, it is possible to suppress the decrease in the temperature of the cooling water by adjusting the heat radiation amount from the cooling water in the radiator. Therefore, it is possible to suppress the closure of the thermostat. Therefore, it is possible to suppress the decrease in the flow rate of the cooling water.

Further, the controller can control the heat radiation amount varier such that the heat radiation amount from the cooling water in the radiator is increased if the temperature of the cooling water is not less than the prescribed temperature as compared with if the temperature of the cooling water is less than the prescribed temperature.

When the temperature of the cooling water is not less than the prescribed temperature, even if the flow rate of the cooling water is increased by allowing the cooling water to flow through the radiator side cooling water route and the bypass side cooling water route, then it is feared that the internal combustion engine may be overheated. In relation thereto, it is possible to lower the cooling water temperature by increasing the heat radiation amount from the cooling water in the radiator. Therefore, it is possible to suppress the internal combustion engine from being overheated.

Advantageous Effects of Invention

According to the present disclosure, it is possible to realize the proper flow rate of the cooling water for the internal combustion engine.

DESCRIPTION OF EMBODIMENTS

An explanation will be made in detail below by way of example with reference to the drawings on the basis of an embodiment about a mode for carrying out the present disclosure. However, for example, the dimension or size, the material, the shape, and the relative arrangement of each of constitutive parts or components described in the embodiment of the present disclosure are not intended to limit the scope of the disclosure only thereto unless specifically noted.

First Embodiment

Figure 1:
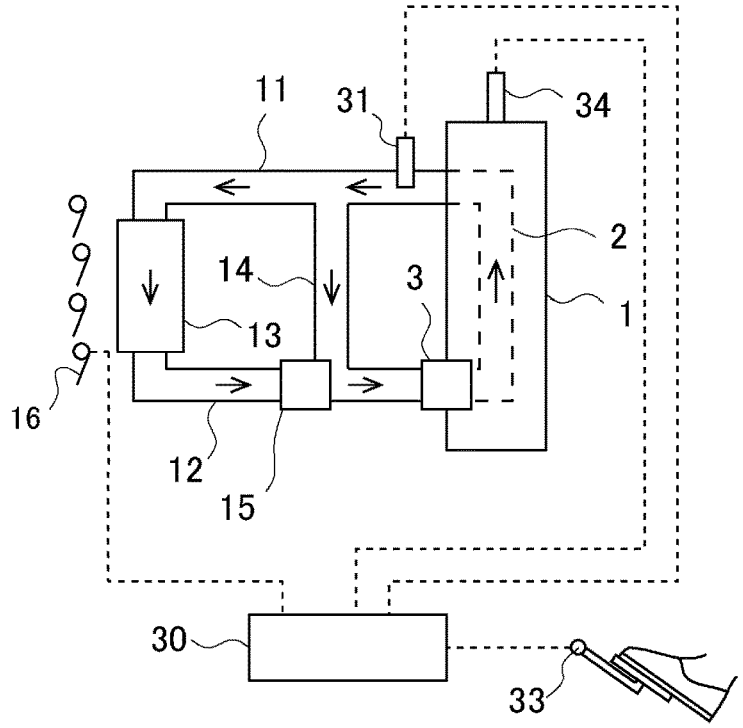
FIG. 1 shows a schematic arrangement of a cooling system for an internal combustion engine according to an embodiment.

FIG. 1 shows a schematic arrangement of a cooling system for an internal combustion engine according to this embodiment. The internal combustion engine 1 shown in FIG. 1 is an internal combustion engine based on the water cooling system. The internal combustion engine 1 is carried, for example, on a vehicle.

A water jacket 2, which is provided to circulate the cooling water, is formed at the inside of the internal combustion engine 1. The water jacket 2 is formed at least around a combustion chamber. Further, a first cooling water passage 11 and a second cooling water passage 12 are connected to the internal combustion engine 1. A radiator 13 and a bypass passage 14 are connected to the first cooling water passage 11 and the second cooling water passage 12.

The first cooling water passage 11 connects the outlet side of the water jacket 2 and the inlet side of the radiator 13. That is, the first cooling water passage 11 is a passage which is provided to discharge the cooling water from the water jacket 2. Further, the second cooling water passage 12 connects the outlet side of the radiator 13 and the inlet side of the water jacket 2. That is, the second cooling water passage 12 is a passage which is provided to supply the cooling water to the water jacket 2.

A water pump 3, which discharges the cooling water from the side of the second cooling water passage 12 to the side of the water jacket 2, is provided at the downstream end of the second cooling water passage 12 (it is also appropriate to say that the water pump 3 is provided on the inlet side of the water jacket 2).

The bypass passage 14 bypasses the radiator 13 by making communication between the first cooling water passage 11 and the second cooling water passage 12. Note that in this embodiment, the radiator 13, the first cooling water passage 11, the second cooling water passage 12, and the water jacket 2 correspond to the radiator side cooling water route according to the present disclosure. Further, the bypass passage 14, the first cooling water passage 11 ranging from the water jacket 2 to the bypass passage 14, the second cooling water passage 12 ranging from the bypass passage 14 to the water jacket 2, and the water jacket 2 correspond to the bypass side cooling water route according to the present disclosure.

The radiator 13 deprives the heat from the cooling water by performing the heat exchange between the air and the cooling water for the internal combustion engine 1. A shutter 16, which opens so that the air flows or which closes so that the flow of the air is shut off, is provided on the upstream side of the radiator 13 (on the front side of the vehicle) in the flow direction of the air passing through the radiator 13. The shutter 16 is provided, for example, for a grill. When the shutter 16 is open, the air passes through the radiator 13. On the other hand, when the shutter 16 is closed, then the amount of the air passing through the radiator 13 is decreased, and the heat radiation amount from the cooling water is remarkably decreased. Note that the shutter 16 may be one which can be fully opened and fully closed and which maintains only any one of the states or the shutter 16 may be one which can maintain an arbitrary opening degree. In this embodiment, an explanation will be made assuming that the shutter 16 is one which can be fully opened and fully closed and which maintains any one of the states. In this embodiment, the shutter 16 corresponds to the heat radiation amount varier according to the present disclosure.

A thermostat 15 is provided at the downstream end of the bypass passage 14, i.e., at the portion at which the bypass passage 14 is connected to the second cooling water passage 12. The cooling water, which flows through the bypass passage 14, always flows into the thermostat 15. Then, the thermostat 15 automatically undergoes the valve opening, for example, in accordance with the thermal expansion of the bimetal or the wax contained therein when the temperature of the cooling water arrives at a threshold value. When the thermostat 15 is closed, the flow of the cooling water is shut off in the second cooling water passage 12. When the thermostat 15 is open, the cooling water flows through the second cooling water passage 12. Note that in this embodiment, the thermostat 15 corresponds to the changer according to the present disclosure.

When the thermostat 15 is closed, the flow of the cooling water from the radiator 13 is shut off. Therefore, the cooling water, which flows out from the water jacket 2 to the first cooling water passage 11, is fed to the water jacket 2 again via the bypass passage 14. The cooling water is gradually warmed by means of the circulation of the cooling water as described above, and the warming-up of the internal combustion engine 1 is facilitated. On the other hand, when the thermostat 15 is open, the cooling water is circulated via the radiator 13 and the bypass passage 14. The thermostat 15 begins to open, for example, when the temperature of the cooling water is 82 degree C., and the thermostat 15 fully opens, for example, when the temperature of the cooling water is 88 degree C. Accordingly, when the shutter 16 is open, the temperature of the cooling water is maintained, for example, at about 85 degree C. Note that the cooling water also circulates through the portions other than the radiator 13 and the bypass passage 14 irrelevant to the state of the thermostat 15. However, these portions are omitted in FIG. 1.

Further, a temperature sensor 31, which measures the temperature of the cooling water flowing out from the water jacket 2, is attached to the first cooling water passage 11. The temperature sensor 31 is attached to the first cooling water passage 11 at the portion disposed on the side of the water jacket 2 as compared with the portion at which the bypass passage 14 is connected.

ECU 30, which is an electronic control unit for controlling the internal combustion engine 1, is provided in combination with the internal combustion engine 1 constructed as described above. ECU 30 controls the internal combustion engine 1 in accordance with the operation condition of the internal combustion engine 1 and/or the request of the driver. Note that in this embodiment, ECU 30 corresponds to the controller according to the present disclosure.

Further, an accelerator opening degree sensor 33 for outputting an electric signal corresponding to the accelerator opening degree to detect the engine load and a crank position sensor 34 for detecting the number of revolutions of the engine are connected to ECU 30 via electric wirings in addition to the sensors described above. Then, the output signals of the sensors are inputted into ECU 30. On the other hand, the shutter 16 is connected to ECU 30 via an electric wiring, and ECU 30 controls the shutter 16.

ECU 30 operates the shutter 16 so that the amount of the cooling water flowing through the water jacket 2 is increased during the high load operation of the internal combustion engine 1. In this case, the heat, which is generated in the internal combustion engine 1, is increased during the high load operation of the internal combustion engine 1, and hence the temperature of the cooling water is raised. Then, if the temperature of the cooling water is not less than a threshold value, then the thermostat 15 is opened, and the cooling water flows through the radiator 13. However, if the shutter 16 is open when the cooling water flows through the radiator 13, the temperature of the cooling water, which is provided on the outlet side of the radiator 13, is less than the threshold value. Note that the threshold value may be a temperature at which the thermostat 15 begins to open.

As described above, when the shutter 16 is open, the heat radiation amount from the cooling water is large in the radiator 13. Therefore, the temperature of the cooling water is lowered, and the thermostat 15 is closed in some cases. If the thermostat 15 is completely closed, the cooling water flows through only the bypass passage 14. Therefore, the pressure loss is increased as compared with that provided when the cooling water flows through the radiator 13. On this account, the flow rate of the cooling water in the water jacket 2 is decreased when the thermostat 15 is closed as compared with when the thermostat 15 is open.

In this case, the combustion chamber has a high temperature during the high load operation of the internal combustion engine 1, and hence it is feared that the knocking may occur. Then, if the flow rate of the cooling water in the water jacket 2 is decreased on account of the closure of the thermostat 15, it is feared that the cooling of the combustion chamber may be insufficient. In general, the larger the flow rate of the cooling water is, the higher the heat transfer coefficient is. Therefore, the effect to lower the temperature of the combustion chamber is more raised. On this account, a larger amount of heat can be deprived from the combustion chamber in some cases when the cooling water having a temperature higher than the threshold value flows through the bypass passage 14 and the radiator 13 as compared with when the cooling water having a temperature approximate to the threshold value flows through only the bypass passage 14.

Accordingly, in this embodiment, the shutter 16 is closed during the high load operation of the internal combustion engine 1 (when the engine load is not less than a predetermined load). The temperature of the cooling water is hardly lowered in the radiator 13 by closing the shutter 16. Therefore, the temperature of the cooling water is maintained while being higher than the threshold value, and the thermostat 15 remains open. Accordingly, the cooling water continuously flows through the radiator 13, and hence the flow rate of the cooling water in the water jacket 2 can be always increased. Note that if the temperature of the cooling water is excessively raised, it is feared that the internal combustion engine 1 may be overheated. Therefore, the shutter 16 is closed as long as the temperature is less than a prescribed temperature.

On the other hand, the shutter 16 is open during the low load operation of the internal combustion engine 1 (when the engine load is less than the predetermined load). That is, the shutter 16 is controlled so that the heat radiation amount from the cooling water in the radiator 13 is increased when the engine load is less than the predetermined load as compared with when the load on the internal combustion engine is not less than the predetermined load. By doing so, the temperature of the cooling water is automatically maintained at the required temperature by means of the thermostat 15. The temperature of the combustion chamber is low during the low load operation, and hence the knocking hardly occurs. Therefore, the heat radiation amount is increased in the radiator 13, and the temperature of the cooling water is lowered. Even if the thermostat 15 is closed, and the flow rate of the cooling water is decreased, then it is possible to suppress the occurrence of the knocking. Further, the temperature of the combustion chamber is easily lowered during the low load operation, and hence the friction loss and/or the cooling loss is/are easily increased. However, it is possible to suppress the decrease in the temperature of the combustion chamber by decreasing the flow rate of the cooling water.

Figure 2:
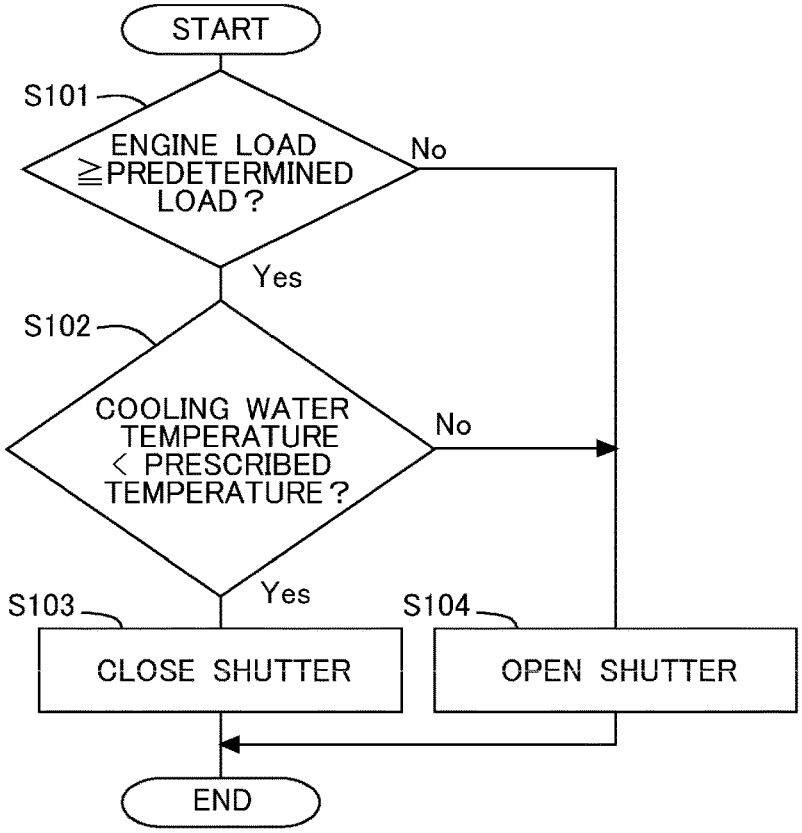
FIG. 2 shows a flow chart illustrating a control flow for a shutter according to the first embodiment.

FIG. 2 shows a flow chart illustrating a control flow for the shutter 16 according to this embodiment. This flow chart is executed by ECU 30 every time when a predetermined time elapses.

In Step S101, it is judged whether or not the engine load is not less than the predetermined load. In this step, it is judged whether or not the internal combustion engine 1 is in the high load operation. The predetermined load is a load which can be referred to as "high load", and the predetermined load can be the load at which the knocking occurs in the internal combustion engine 1 or the load at which it is feared that the knocking may occur when the cooling water is not allowed to flow through the radiator 13 and the cooling water is allowed to flow through the bypass passage 14. If the affirmative judgment is made in Step S101, the routine proceeds to Step S102. On the other hand, if the negative judgment is made, then the routine proceeds to Step S104, and the shutter 16 is opened. In this case, if the engine load is less than the predetermined load, then the cooling water temperature is maintained in the vicinity of the threshold value by opening the shutter 16, and thus the fuel efficiency is improved.

In Step S102, it is judged whether or not the cooling water temperature is less than the prescribed temperature. The prescribed temperature is a temperature at which the internal combustion engine 1 is overheated or a temperature at which it is feared that the internal combustion engine 1 may be overheated. If the affirmative judgment is made in Step S102, the routine proceeds to Step S103. On the other hand, if the negative judgment is made, then the routine proceeds to Step S104, and the shutter 16 is opened. In this case, if the cooling water temperature is not less than the prescribed temperature, the cooling water temperature can be lowered by opening the shutter 16. Therefore, it is possible to suppress the internal combustion engine 1 from being overheated.

In Step S103, the shutter 16 is closed. That is, it is feared that the knocking may occur. Therefore, the temperature of the cooling water is made to be not less than the threshold value by closing the shutter 16, and the thermostat 15 is opened. Accordingly, it is possible to maintain the state in which the flow rate of the cooling water is large in the water jacket 2. Therefore, it is possible to suppress the increase in the temperature of the combustion chamber. Therefore, it is possible to suppress the occurrence of the knocking.

In this way, if the engine load is not less than the predetermined load, and the cooling water temperature is less than the prescribed temperature, then Step S101, Step S102, and Step S103 are repeatedly executed. Accordingly, the temperature of the cooling water can be maintained to be not less than the threshold value. Therefore, it is possible to maintain the state in which the thermostat 15 is open, and hence it is possible to continuously cool the combustion chamber even in the case of the high load operation state. That is, even in the case of the state in which the engine load is high, the heat radiation amount from the cooling water is intentionally decreased so that the flow rate of the cooling water is not lowered. Thus, it is possible to preferably cool the internal combustion engine 1.

However, the decrease in the temperature of the cooling water is suppressed during the period in which the shutter 16 is closed. Therefore, the temperature of the cooling water is raised to be not less than the prescribed temperature in some cases. In such a situation, the negative judgment is made in Step S102. Therefore, the routine proceeds to Step S104, and the shutter 16 is opened. When the shutter 16 is opened, the heat radiation amount from the cooling water in the radiator 13 is increased thereby. Therefore, it is possible to lower the temperature of the cooling water. If the temperature of the cooling water is lowered to be less than the prescribed temperature, the affirmative judgment is made in Step S102. The routine proceeds to Step S103, and the shutter 16 is closed again. Accordingly, the thermostat 15 is maintained while being opened. In this way, the temperature of the cooling water can be maintained to be not less than the threshold value, while suppressing the temperature of the cooling water from being raised to be not less than the prescribed temperature.

Further, the engine load is less than the predetermined load in some cases in the course of the repeated execution of Step S101, Step S102, and Step S103. In such a situation, the negative judgment is made in Step S101. Therefore, the routine proceeds to Step S104, and the shutter 16 is opened. When the shutter 16 is opened, the temperature of the cooling water is lowered thereby. Then, the temperature of the cooling water is maintained in the vicinity of the threshold value owing to the action of the thermostat 15, and the flow rate of the cooling water is decreased. Therefore, it is possible to suppress the decrease in the temperature of the combustion chamber. Accordingly, it is possible to suppress the increase in the friction loss and/or the cooling loss.

Figure 3:
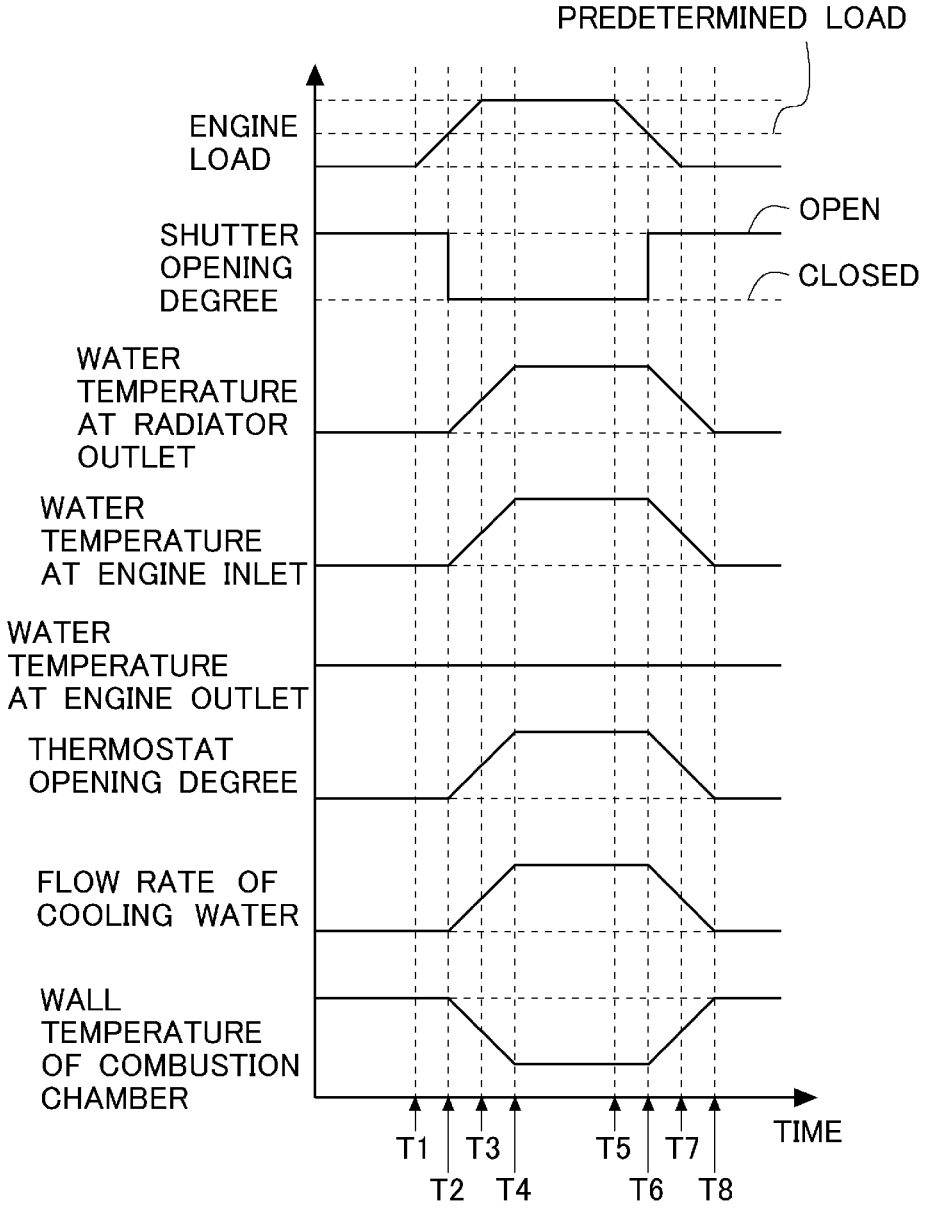
FIG. 3 shows a time chart conceptually illustrating the transition of the engine load, the opening degree of the shutter, the cooling water temperature at the outlet of a radiator (water temperature at the radiator outlet), the cooling water temperature at the inlet of the internal combustion engine (water temperature at the engine inlet), the cooling water temperature at the outlet of the internal combustion engine (water temperature at the engine outlet), the opening degree of a thermostat, the flow rate of the cooling water flowing into the internal combustion engine (cooling water flow rate), and the wall temperature of a combustion chamber.

FIG. 3 shows a time chart conceptually illustrating the transition of the engine load, the opening degree of the shutter 16, the cooling water temperature at the outlet of the radiator 13 (water temperature at the radiator outlet), the cooling water temperature at the inlet of the internal combustion engine 1 (water temperature at the engine inlet), the cooling water temperature at the outlet of the internal combustion engine 1 (water temperature at the engine outlet), the opening degree of the thermostat 15, the flow rate of the cooling water flowing into the internal combustion engine 1 (cooling water flow rate), and the wall temperature of the combustion chamber. The water temperature at the engine outlet is approximately equal to the cooling water temperature at the inlet of the radiator 13 (water temperature at the radiator inlet).

The engine load begins to rise at the point in time indicated by T1. In this situation, the shutter 16 is fully open. The engine load increases to the predetermined load at the point in time indicated by T2. The shutter 16 is open before the point in time indicated by T2, and hence the cooling ability of the cooling water in the radiator 13 is sufficiently high. Further, the engine load is also low before the point in time indicated by T2, and hence the water temperature at the engine inlet is maintained to be constant even when the opening degree of the thermostat 15 is small. Note that the opening degree of the thermostat 15 is constant at a relatively small opening degree before the point in time indicated by T2. Then, when the engine load increases to the predetermined load at the point in time indicated by T2, the shutter 16 is closed by ECU 30. Accordingly, the heat is hardly radiated in the radiator 13. Therefore, the water temperature at the radiator outlet and the water temperature at the engine inlet begin to rise. The opening degree of the thermostat 15 is increased in accordance with the rise in the water temperature at the radiator outlet and the water temperature at the engine inlet. Then, the flow rate of the cooling water passing through the radiator 13 is increased in accordance with the increase in the opening degree of the thermostat 15. Therefore, the flow rate of the cooling water flowing into the internal combustion engine 1 is increased. Accordingly, the wall temperature of the combustion chamber begins to lower.

The rise in the engine load comes to an end and the engine load becomes constant at the point in time indicated by T3. However, the engine load is not less than the predetermined load in this situation, and hence the shutter 16 is maintained while being closed. Therefore, the water temperature at the radiator outlet continues to rise. Accordingly, the opening degree of the thermostat 15 is further increased as well, and the flow rate of the cooling water flowing into the internal combustion engine 1 also continues to increase. On this account, it is possible to further lower the wall temperature of the combustion chamber. The water temperature at the radiator outlet becomes constant at the point in time indicated by T4. In this case, even when the shutter 16 is closed, it is difficult to completely shut off the heat radiation from the radiator 13. When the opening degree of the thermostat 15 is provided such that the heat radiated from the radiator 13 is balanced with the heat received from the internal combustion engine 1, the opening degree of the thermostat 15 becomes constant. That is, even when the shutter 16 is closed, the water temperature at the radiator outlet becomes constant in accordance with the heat radiation from the radiator 13. Further, as a result of the constant opening degree of the thermostat 15, the flow rate of the cooling water becomes constant, and the wall temperature of the combustion chamber becomes constant as well. The water temperature at the engine inlet rises during the period ranging from T2 to T4. However, in this situation, the opening degree of the thermostat 15 is increased, and thus the flow rate of the cooling water is increased as well. On this account, the amount of heat, which is received by the cooling water per unit volume at the inside of the internal combustion engine 1, is relatively lowered, and hence the rise in the cooling water temperature is suppressed. Therefore, the water temperature at the engine outlet becomes constant.

The engine load begins to fall from the point in time indicated by T5. Note that the shutter 16 is not opened even when the engine load merely begins to fall. When the engine load is decreased to the predetermined load at the point in time indicated by T6, the shutter 16 is opened. Accordingly, the water temperature at the radiator outlet begins to fall, and hence the opening degree of the thermostat 15 is also decreased. On account of the decrease in the opening degree of the thermostat 15, the flow rate of the cooling water is decreased. Therefore, the wall temperature of the combustion chamber begins to rise.

The fall in the engine load is terminated at the point in time indicated by T7. However, in this situation, the water temperature at the radiator outlet is still high. Therefore, the thermostat 15 is in the course of the closing process. Then, the opening degree of the thermostat 15 is provided at the point in time indicated by T8 such that the heat radiated from the radiator 13 is balanced with the heat received from the internal combustion engine 1. The opening degree of the thermostat 15 becomes constant at and after the point in time indicated by T8. Accordingly, the water temperature at the radiator outlet, the flow rate of the cooling water, and the wall temperature of the combustion chamber become constant. The water temperature at the engine inlet falls during the period ranging from T6 to T8. However, in this situation, the opening degree of the thermostat 15 is decreased, and thus the flow rate of the cooling water is decreased as well. On this account, the amount of heat, which is received by the cooling water per unit volume at the inside of the internal combustion engine 1, is relatively increased, and hence the fall in the cooling water temperature is suppressed. Therefore, the water temperature at the engine outlet becomes constant.

As explained above, according to this embodiment, the shutter 16 is closed when the engine load is not less than the predetermined load irrelevant to the velocity of the vehicle, and thus it is possible to increase the flow rate of the cooling water. Accordingly, it is possible to lower the temperature of the combustion chamber, and hence it is possible to suppress the occurrence of the knocking. Further, when the temperature of the cooling water is not less than the prescribed temperature, it is possible to lower the temperature of the cooling water by opening the shutter 16. Therefore, it is possible to suppress the internal combustion engine 1 from being overheated. That is, the shutter 16 is controlled so that the temperature of the cooling water is not less than the threshold value and less than the prescribed temperature when the load on the internal combustion engine 1 is not less than the predetermined load. Thus, it is possible to suppress the overheat of the internal combustion engine 1, it is possible to suppress the occurrence of the knocking, and it is possible to improve the fuel efficiency. Further, when the engine load is less than the predetermined load, the flow rate of the cooling water is decreased by opening the shutter 16. Therefore, it is possible to maintain such a situation that the temperature of the combustion chamber remains high. On this account, it is possible to reduce the friction loss and the cooling loss. Therefore, it is possible to improve the fuel efficiency.

Note that in this embodiment, the explanation has been made assuming that the shutter 16 is fully closed when the shutter 16 is closed. However, in place thereof, when the shutter 16 is closed, the shutter 16 may have an opening degree which is smaller than that provided when the shutter 16 is fully opened and which is larger that provided when the shutter 16 is fully closed. Further, in this embodiment, the opening degree of the thermostat 15 may be adjusted by changing the opening degree of the shutter 16 depending on the load on the internal combustion engine 1 to change the flow rate of the cooling water in the water jacket 2 in place of one in which the shutter 16 is fully closed when the shutter 16 is closed. In these cases, a shutter 16, which can be maintained at an arbitrary opening degree, is used.

Figure 4:
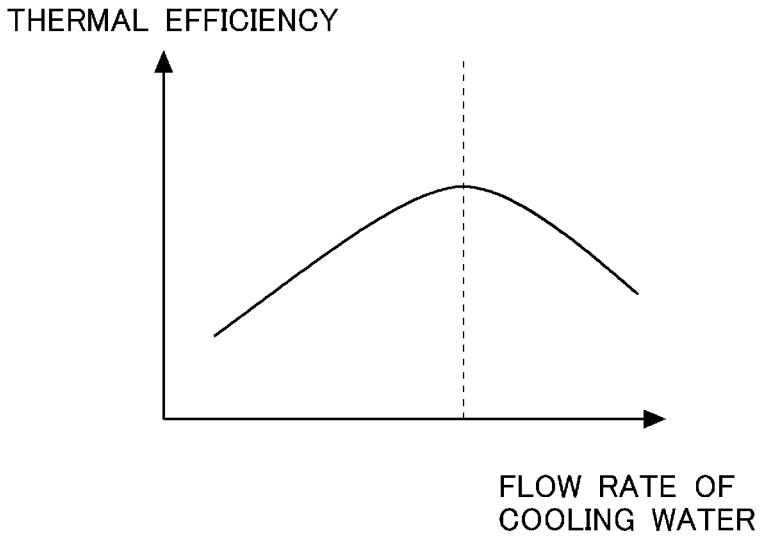
FIG. 4 shows a relationship between the flow rate of the cooling water and the thermal efficiency in the internal combustion engine.
Figure 5:
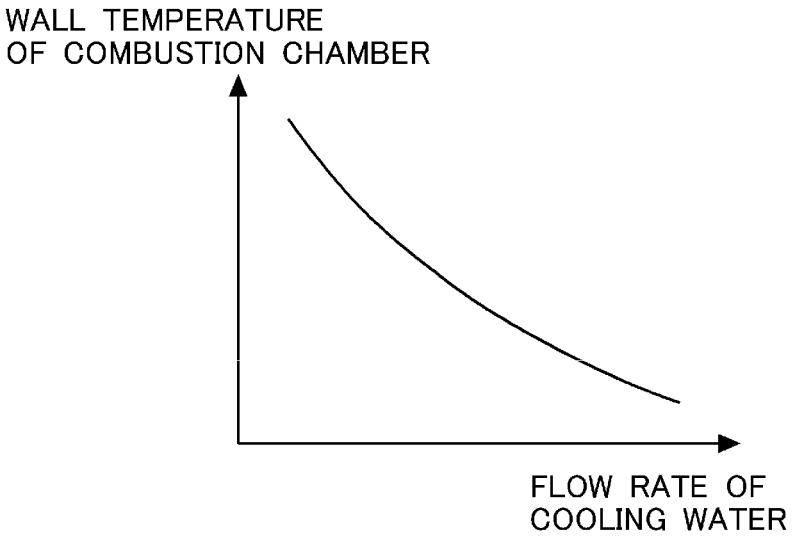
FIG. 5 shows a relationship between the flow rate of the cooling water and the wall temperature of the combustion chamber.

In this case, FIG. 4 shows a relationship between the flow rate of the cooling water and the thermal efficiency in the internal combustion engine. Further, FIG. 5 shows a relationship between the flow rate of the cooling water and the wall temperature of the combustion chamber. If only the wall temperature of the combustion chamber shown in FIG. 5 is investigated, it seems that the larger the flow rate of the cooling water is, the lower the wall temperature of the combustion chamber is. However, as shown in FIG. 4, the thermal efficiency has a maximum value. In relation thereto, when the flow rate of the cooling water is progressively increased, then the occurrence of the knocking is suppressed, and hence the thermal efficiency is raised. However, when the flow rate of the cooling water is increased to some extent, then the influence, which is exerted by the cooling loss and/or the friction loss, is increased, and hence the thermal efficiency is lowered. Therefore, the thermal efficiency has the maximum value at the flow rate of the cooling water at which the influence, which is exerted by the cooling loss and/or the friction loss, begins to increase.

Note that the flow rate of the cooling water, at which the thermal efficiency is the highest, changes depending on the engine load. The higher the engine load is, the more easily the knocking occurs. Therefore, when the flow rate of the cooling water is increased, the effect to suppress the knocking is increased. On this account, the maximum value of the thermal efficiency is moved toward the side of the high flow rate, as the engine load is more raised.

In view of the above, in this embodiment, it is also allowable to change the flow rate of the cooling water by changing the opening degree of the thermostat 15 by changing the opening degree of the shutter 16 depending on the engine load.

Specifically, in Step S103 described above, the shutter 16 is not fully closed when the shutter 16 is closed. Instead, the higher the engine load at the present point in time is, the smaller the opening degree of the shutter 16 is. The heat radiation amount in the radiator 13 can be more decreased, as the opening degree of the shutter 16 is smaller. Therefore, the temperature of the cooling water is raised. Therefore, the opening degree of the thermostat 15 is more increased, and hence it is possible to increase the amount of the cooling water flowing through the radiator 13. Accordingly, it is possible to increase the amount of the cooling water flowing through the water jacket 2. The relationship between the engine load and the opening degree of the shutter 16 can be previously determined, for example, by means of any experiment or any simulation.

Second Embodiment

In this embodiment, an on-off valve, which is opened/closed, for example, by an electric motor, is provided in place of the thermostat 15. The flow passage for the cooling water is changed by opening/closing the on-off valve. For example, the other apparatuses or devices are the same as those of the first embodiment, any explanation of which will be omitted.

Figure 6:
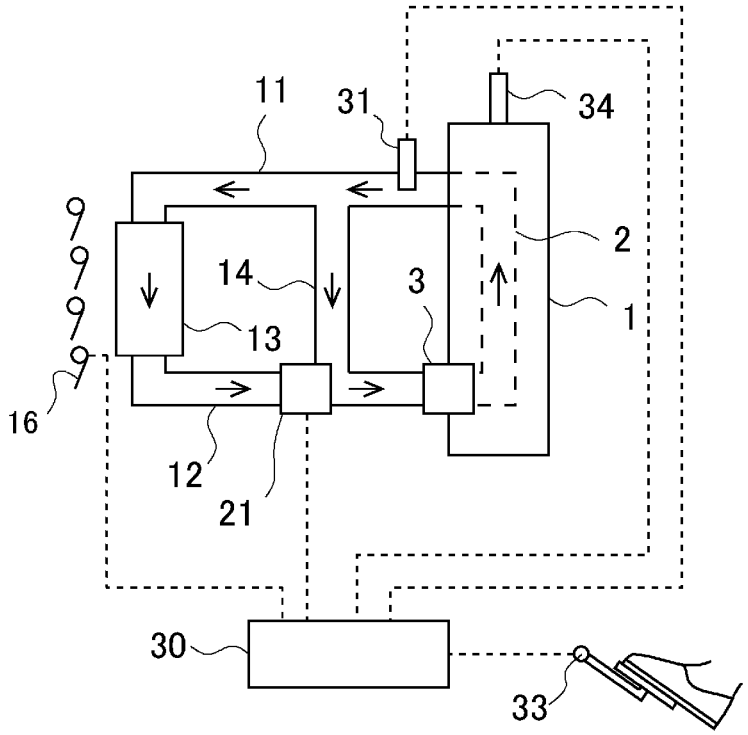
FIG. 6 shows a schematic arrangement of a cooling system for an internal combustion engine according to a second embodiment.

FIG. 6 shows a schematic arrangement of a cooling system for an internal combustion engine according to this embodiment. An on-off valve 21 is provided at a connecting portion between the second cooling water passage 12 and the bypass passage 14. The on-off valve 21 opens/closes in accordance with a signal supplied from ECU 30. ECU 30 opens the on-off valve 21 if the temperature of the cooling water, which is detected by the temperature sensor 31, is not less than a threshold value, while ECU 30 closes the on-off valve 21 if the temperature of the cooling water is less than the threshold value. Note that in this embodiment, the on-off valve 21 corresponds to the changer according to the present disclosure.

When the on-off valve 21 is closed, the cooling water, which flows out from the water jacket 2 to the first cooling water passage 11, is fed to the water jacket 2 again via the bypass passage 14. On the other hand, when the on-off valve 21 is open, the cooling water is circulated via the radiator 13 and the bypass passage 14.

In this way, even when the on-off valve 21 is opened/closed depending on the temperature of the cooling water, it is possible to perform the control of the cooling water temperature in the same manner as that performed with the thermostat 15 of the embodiment described above. Then, if the shutter 16 is closed when the engine load is not less than the predetermined load, then the cooling water temperature is not less than the threshold value. Therefore, ECU 30 opens the on-off valve 21. Accordingly, the flow rate of the cooling water is increased, and hence it is possible to lower the temperature of the combustion chamber. Accordingly, it is possible to suppress the occurrence of the knocking.

Third Embodiment

Figure 7:
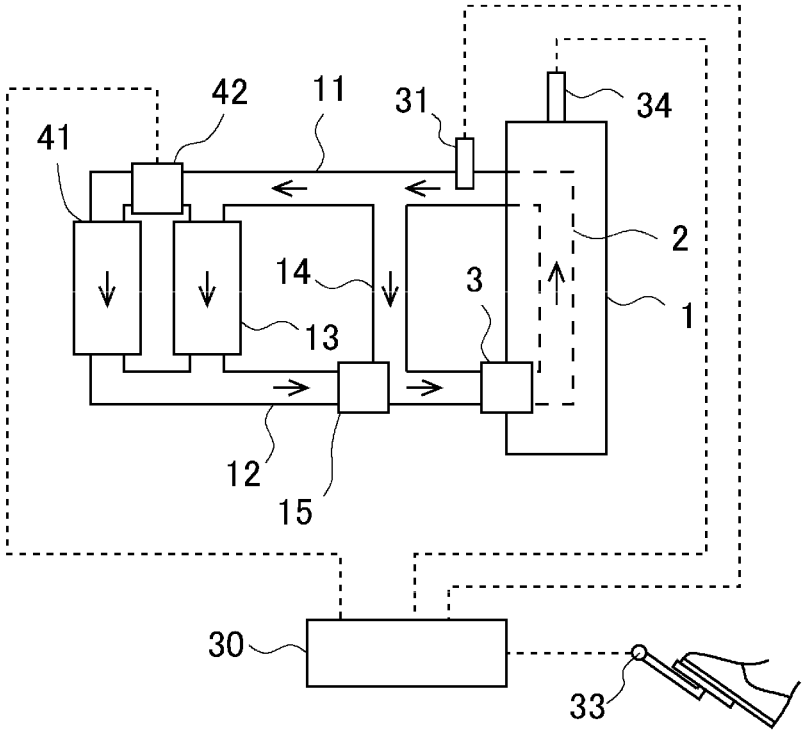
FIG. 7 shows a schematic arrangement of a cooling system for an internal combustion engine according to a third embodiment.

FIG. 7 shows a schematic arrangement of a cooling system for an internal combustion engine according to this embodiment. In this embodiment, the shutter 16 is not provided. On the other hand, a second radiator 41 is provided in parallel to the radiator 13. Further, an on-off valve 42, which opens/closes in accordance with a signal fed from ECU 30, is provided for the first cooling water passage 11 on the inlet side of the second radiator 41. Note that in this embodiment, the on-off valve 42 corresponds to the heat radiation amount varier according to the present disclosure.

In this case, if the on-off valve 42 is opened when the thermostat 15 is open, then the cooling water flows through the radiator 13 and the second radiator 41. Therefore, it is possible to deprive a larger amount of heat from the cooling water. That is, when the on-off valve 42 is opened, the effect, which is the same as or equivalent to that obtained when the shutter 16 is opened, can be obtained. On the other hand, if the on-off valve 42 is closed when the thermostat 15 is open, then the cooling water does not flow through the second radiator 41, and the cooling water flows through only the radiator 13. On this account, when the on-off valve 42 is closed, the heat deprived from the cooling water is decreased as compared with when the on-off valve 42 is open. That is, when the on-off valve 42 is closed, the effect, which is the same as or equivalent to that obtained when the shutter 16 is closed, can be obtained.

Therefore, if ECU 30 closes the on-off valve 42 when the engine load is not less than the predetermined load, the cooling water temperature is not less than the threshold value. Accordingly, the flow rate of the cooling water is increased. Therefore, it is possible to lower the temperature of the combustion chamber. Accordingly, it is possible to suppress the occurrence of the knocking.

What is claimed is:

1. A cooling system for an internal combustion engine, comprising:

a radiator configured to radiate heat from cooling water for the internal combustion engine;

a radiator side cooling water route configured to circulate the cooling water through the radiator and the internal combustion engine;

a bypass side cooling water route configured to circulate the cooling water through the internal combustion engine while detouring the radiator;

a changer configured to allow the cooling water to flow through the radiator side cooling water route and the bypass side cooling water route if a temperature of the cooling water for the internal combustion engine is not less than a threshold value, and configured to allow the cooling water to flow through the bypass side cooling water route while not allowing the cooling water to flow through the radiator side cooling water route if the temperature of the cooling water for the internal combustion engine is less than the threshold value;

a heat radiation amount varier configured to vary a heat radiation amount from the cooling water in the radiator, the heat radiation amount varier being a shutter which opens/closes on a flow passage for air when the air passes through the radiator, a controller configured to, under a load condition of the internal combustion engine where the load of the internal combustion engine is equal to or higher than a predetermined load, control the heat radiation amount by closing the shutter such that the temperature of the cooling water is equal to or higher than the threshold value and lower than a prescribed temperature that is higher than the threshold value, and configured to, under another load condition of the internal combustion engine where the load of the internal combustion engine is less than the predetermined load, control the heat radiation amount by opening the shutter such that the heat radiation amount from the cooling water in the radiator is larger than that in the case where the load of the internal combustion engine is equal to or higher than the predetermined load.

2. The cooling system for the internal combustion engine according to claim 1, wherein the changer is a thermostat configured to allow the cooling water to flow through the radiator side cooling water route and the bypass side cooling water route if the temperature of the cooling water for the internal combustion engine is not less than the threshold value and configured to allow the cooling water to flow through the bypass side cooling water route while not allowing the cooling water to flow through the radiator side cooling water route if the temperature of the cooling water for the internal combustion engine is less than the threshold value.

3. The cooling system for the internal combustion engine according to claim 1, wherein the flow rate of the cooling water in the internal combustion engine is substantially increased when the cooling water is allowed to flow through both of the radiator side cooling water route and the bypass side cooling water route as compared with when the cooling water is allowed to flow through only the bypass side cooling water route, and wherein a larger amount of heat is removed from the internal combustion engine by increasing the flow rate of the cooling water.

4. A cooling system for an internal combustion engine, comprising:

a radiator configured to radiate heat from cooling water for the internal combustion engine;

a radiator side cooling water route configured to circulate the cooling water through the radiator and the internal combustion engine;

a bypass side cooling water route configured to circulate the cooling water through the internal combustion engine while detouring the radiator;

a changer configured to allow the cooling water to flow through the radiator side cooling water route and the bypass side cooling water route if a temperature of the cooling water for the internal combustion engine is not less than a threshold value, and configured to allow the cooling water to flow through the bypass side cooling water route while not allowing the cooling water to flow through the radiator side cooling water route if the temperature of the cooling water for the internal combustion engine is less than the threshold value;

a heat radiation amount varier configured to vary a heat radiation amount from the cooling water in the radiator, the heat radiation amount varier being a shutter which opening degree is adjustable on a flow passage for air when the air passes through the radiator, a controller configured to, under a load condition of the internal combustion engine where the load of the internal combustion engine is equal to or higher than a predetermined load, control the heat radiation amount by decreasing the opening degree of the shutter such that the temperature of the cooling water is equal to or higher than the threshold value and lower than a prescribed temperature that is higher than the threshold value, and configured to, under another load condition of the internal combustion engine where the load of the internal combustion engine is less than the predetermined load, control the heat radiation amount by increasing the opening degree of the shutter such that the heat radiation amount from the cooling water in the radiator is larger than that in the case where the load of the internal combustion engine is equal to or higher than the predetermined load.

5. The cooling system for the internal combustion engine according to claim 4, wherein the changer is a thermostat configured to allow the cooling water to flow through the radiator side cooling water route and the bypass side cooling water route if the temperature of the cooling water for the internal combustion engine is not less than the threshold value and configured to allow the cooling water to flow through the bypass side cooling water route while not allowing the cooling water to flow through the radiator side cooling water route if the temperature of the cooling water for the internal combustion engine is less than the threshold value.

* * * * *